US010556640B2

(12) United States Patent
Guan et al.

(10) Patent No.: US 10,556,640 B2
(45) Date of Patent: Feb. 11, 2020

(54) UNMANNED SEMI-SUBMARINE

(71) Applicant: Dalian University of Technology, Dalian (CN)

(72) Inventors: Guan Guan, Dalian (CN); Yanyun Yu, Dalian (CN); Ming Chen, Dalian (CN); Yunlong Wang, Dalian (CN); Chaoguang Jin, Dalian (CN); Kai Li, Dalian (CN); Yan Lin, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 0 days.

(21) Appl. No.: 15/985,688

(22) Filed: May 21, 2018

(65) Prior Publication Data

US 2018/0339748 A1 Nov. 29, 2018

(30) Foreign Application Priority Data

May 23, 2017 (CN) ..... 2017 1 0368570

(51) Int. Cl.

| | |
|---|---|
| ***B63G 8/08*** | (2006.01) |
| ***B63B 1/04*** | (2006.01) |
| ***B63G 8/00*** | (2006.01) |
| ***B63G 8/06*** | (2006.01) |
| ***B63H 21/17*** | (2006.01) |
| ***B63G 8/39*** | (2006.01) |

(52) U.S. Cl.

CPC ..... *B63B 1/04* (2013.01); *B63G 8/001* (2013.01); *B63G 8/06* (2013.01); *B63G 8/39* (2013.01); *B63H 21/17* (2013.01); *B63B 2001/044* (2013.01); *B63B 2702/12* (2013.01); *B63G 2008/004* (2013.01)

(58) Field of Classification Search

CPC . B63G 8/00; B63G 8/001; B63G 8/04; B63G 8/06; B63G 8/08; B63G 8/14; B63G 8/36; B63G 2008/00; B63G 2008/001; B63G 2008/002; B63G 2008/004; B63G 2008/08; B63B 1/04; B63B 2001/04; B63B 2001/044

USPC ..... 114/256, 312, 313, 321, 337, 338, 339

See application file for complete search history.

(56) References Cited

U.S. PATENT DOCUMENTS 4,823,722 A * 4/1989 Gass ..... B63B 1/107 114/333

7,281,484 B1 * 10/2007 Alvarez-Calderon ... B63G 8/00 114/312

* cited by examiner

*Primary Examiner* — Daniel V Venne

(74) *Attorney, Agent, or Firm* — Matthias Scholl P.C.; Matthias Scholl

(57) ABSTRACT

An unmanned semi-submarine, including a main hull; airfoil buoyancy chambers; an antenna; a radar; a propeller; a rudder; and compartments. The airfoil buoyancy chambers include a front buoyancy chamber and a rear buoyancy chamber. The front buoyancy chamber and the rear airfoil buoyancy chamber are longitudinally distributed on the main hull. The radar and the antenna are disposed on the top end of the front buoyancy chamber. The rudder is disposed on the rear buoyancy chamber. The propeller is disposed at the tail of the main hull to drive the unmanned semi-submarine. The horizontal sections of the front buoyancy chamber and the rear buoyancy chamber are symmetrical airfoil. The compartments include a front equipment compartment, a rear equipment compartment, a control equipment compartment, a battery compartment, and a propelling compartment. The compartments are separated from one another using watertight walls.

2 Claims, 4 Drawing Sheets

UNMANNED SEMI-SUBMARINE

CROSS-REFERENCE TO RELATED APPLICATIONS

Pursuant to 35 U.S.C. § 119 and the Paris Convention Treaty, this application claims foreign priority to Chinese Patent Application No. 201710368570.X filed May 23, 2017, the contents of which and any intervening amendments thereto are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, and Cambridge, Mass. 02142.

BACKGROUND OF THE INVENTION

Field of the Invention

This disclosure relates to the field of shipbuilding and ocean engineering, and more particularly to an unmanned semi-submarine.

Description of the Related Art

Unmanned ships play an increasingly important role in the field of marine resource exploration and intelligence gathering. However, because a large part of the ships is exposed out of the water surface, the operation of the ships is adversely affected by the rough seas. This reduces the measurement accuracy of the detection equipment installed on the ships.

SUMMARY OF THE INVENTION

In view of the above-described problems, it is an objective of the invention to provide an unmanned semi-submarine that has a relatively small water plane area and can sail stably even in the presence of rough seas.

To achieve the above objective, according to one embodiment of the invention, there is provided an unmanned semi-submarine, comprising a main hull; airfoil buoyancy chambers; an antenna; a radar; a propeller; a rudder; and compartments. The airfoil buoyancy chambers comprise a front buoyancy chamber and a rear buoyancy chamber. The front buoyancy chamber and the rear airfoil buoyancy chamber are longitudinally distributed on the main hull. The radar and the antenna are disposed on a top end of the front buoyancy chamber. The rudder is disposed on the rear buoyancy chamber to control a forward direction of the unmanned semi-submarine. The propeller is disposed at a tail of the main hull to drive the unmanned semi-submarine; cross-sections of the front buoyancy chamber and the rear buoyancy chamber are symmetrical. The compartments comprise a front equipment compartment, a rear equipment compartment, a control equipment compartment, a battery compartment, and a propelling compartment. The compartments are separated from one another using watertight walls. The radar and the antenna are connected to the control equipment compartment. The front equipment compartment and the rear equipment compartment are equipped with a sonar and a depth probe. The control equipment compartment is equipped with processors for obstacle avoidance, route planning, and real-time processing detection data. The propelling compartment is equipped with a propulsion system and a rudder driving mechanism; a battery pack is installed in the battery compartment. The battery compartment is disposed in a bottom of the main hull. The propelling compartment comprises a DC motor, a reduction gearbox, a transmission shaft, an upper support plate, support pillars, and a lower support plate. The DC motor is connected to the reduction gearbox. The reduction gearbox is connected to the propeller via the transmission shaft. The DC motor and the reduction gearbox are disposed on the lower support plate. The upper support plate is located above the DC motor and the reduction gearbox. The support pillars are disposed on the lower support plate and support the upper support plate; a driver motor is disposed on the upper support plate to supply steering power for the rudder. The DC motor and the drive motor are both controlled by a controller in the control equipment compartment.

In a class of this embodiment, the front buoyancy chamber and the rear airfoil buoyancy chamber are spaced apart, and a dimension of the rear buoyancy chamber is larger than a dimension of the front buoyancy chamber.

Advantages of the unmanned semi-submarine are summarized as follows:

1. The unmanned semi-submarine of the disclosure comprises a main hull, airfoil buoyancy chambers, sensors, control system, propulsion system and communication system. The airfoil buoyancy chambers are connected to the main hull, parts of the airfoil buoyancy chambers are submerged in the water, and the other parts are exposed out of the water and provide a reserve buoyancy for the unmanned semi-submarine. Communication equipment, such as radar and antenna, is disposed on the top end of the buoyancy chambers. The airfoil buoyancy chambers can also provide the restoring moment when the unmanned semi-submarine is tilted, ensuring the tilting is restricted in a small angle, increasing the safety of the unmanned semi-submarine.

2. The main hull is completely submerged in the water. The main dimension of the airfoil buoyancy chambers is much less than that of the main hull, thus greatly reducing the wave load imposing on the unmanned submarines under the rough seas, so the dynamic response and the wave resistance are significantly decreased.

3. The compartments comprise a front equipment compartment, a rear equipment compartment, a control equipment compartment, a battery compartment, and a propelling compartment. The division of the compartments helps enhance the resistance to sinking of the unmanned submarines. The battery compartment is placed at the bottom of the main hull to play the role of the ballast so that the center of gravity is always controlled under the floating center and has the self-righting function under any vertical and horizontal angle.

4. Compared with conventional submarines, the number of active components of the unmanned semi-submarine of the disclosure is significantly reduced, and the reliability and maintainability of the entire submarine are improved. The main hull of the unmanned submarine is submerged in the sea, improving the navigation concealment.

Figure 1:
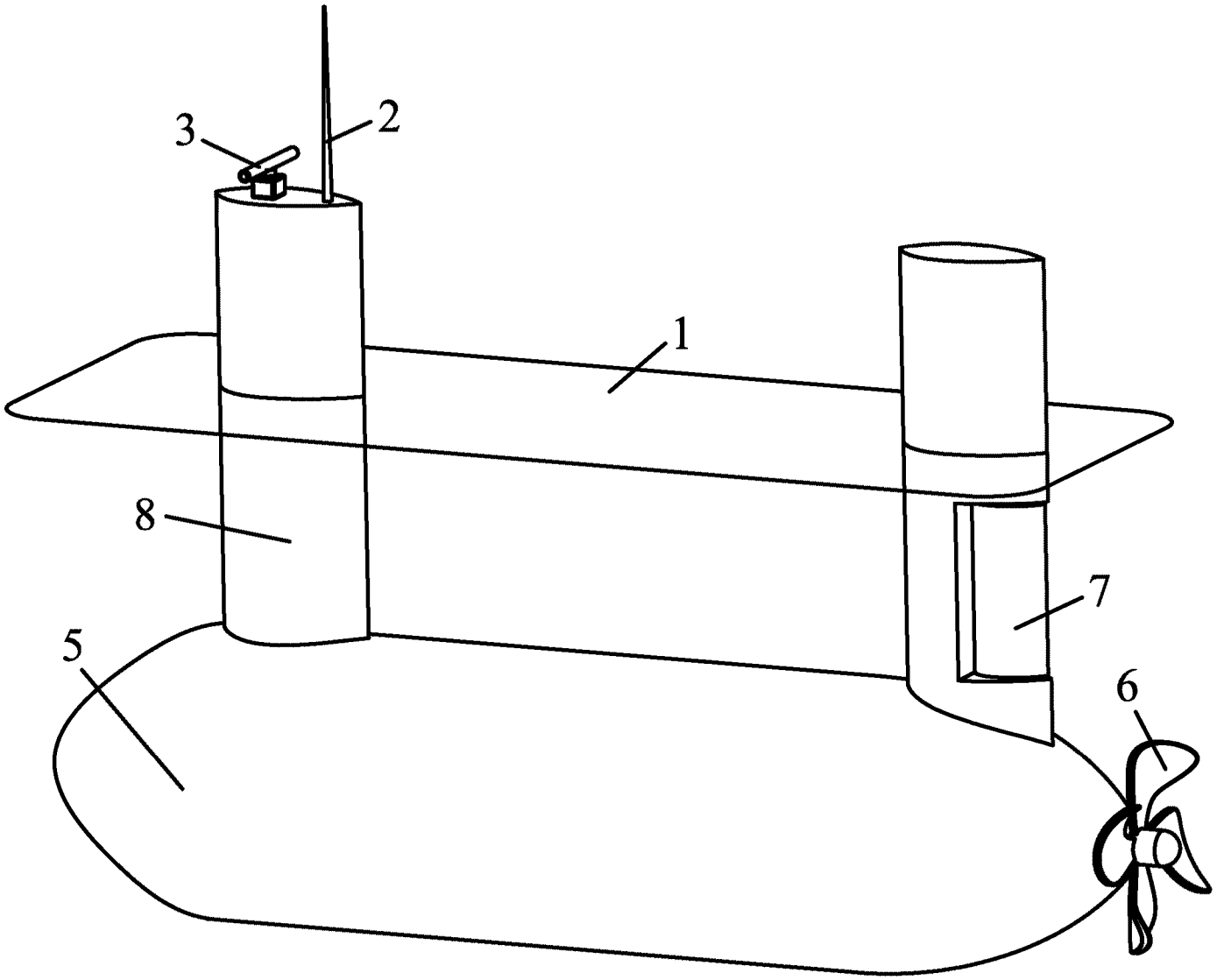
FIG. 1 is an axonometric view of an unmanned semi-submarine according to one embodiment of the disclosure.

In the drawings, the following reference numbers are used: 1. Water surface; 2. Antenna; 3. Radar; 5. Main hull; 6. Propeller; 7. Rudder; 8. Front buoyancy chamber; 9. Front equipment compartment; 10. Rear equipment compartment; 11. Control equipment compartment; 12. Battery compartment; 13. Propelling compartment; 14. Rear buoyancy chamber; 15. Watertight wall; 16. DC motor; 17. Lower support plate; 18. Support pillar; 19. Reduction gearbox; 20. Upper support plate; 21. Drive motor; 22. Sea wave; 23. Calm sea; 24. Buoyancy increased area; 25. Buoyancy decreased area.

DETAILED DESCRIPTION OF THE EMBODIMENTS

To further illustrate the invention, experiments detailing an unmanned semi-submarine are described below. It should be noted that the following examples are intended to describe and not to limit the invention.

FIG. 1 illustrates a small waterplane mono-hull unmanned semi-submarine. The unmanned semi-submarine comprises a main hull 5, airfoil buoyancy chambers, a rudder 7, a propeller 6, a radar 3, and an antenna 2. The airfoil buoyancy chambers comprise a front buoyancy chamber 8 and a rear buoyancy chamber 14. The front buoyancy chamber and the rear airfoil buoyancy chamber are longitudinally distributed apart on the main hull 5. In operation, the main hull is under the water surface 1. The symmetry axis of the cross-sections of the airfoil buoyancy chambers is coincident with the forward direction of the main hull 5. The radar 3 and the antenna 2 are disposed on the top end of the airfoil buoyancy chambers for detection, communication and navigation. The rudder 7 is disposed on the rear buoyancy chamber 14 to control the forward direction of the unmanned semi-submarine. The vertical height of the rudder 7 is lower than the sea level in normal operation. The propeller 6 is disposed at the tail of the main hull 5 to drive the unmanned semi-submarine.

Figure 2:
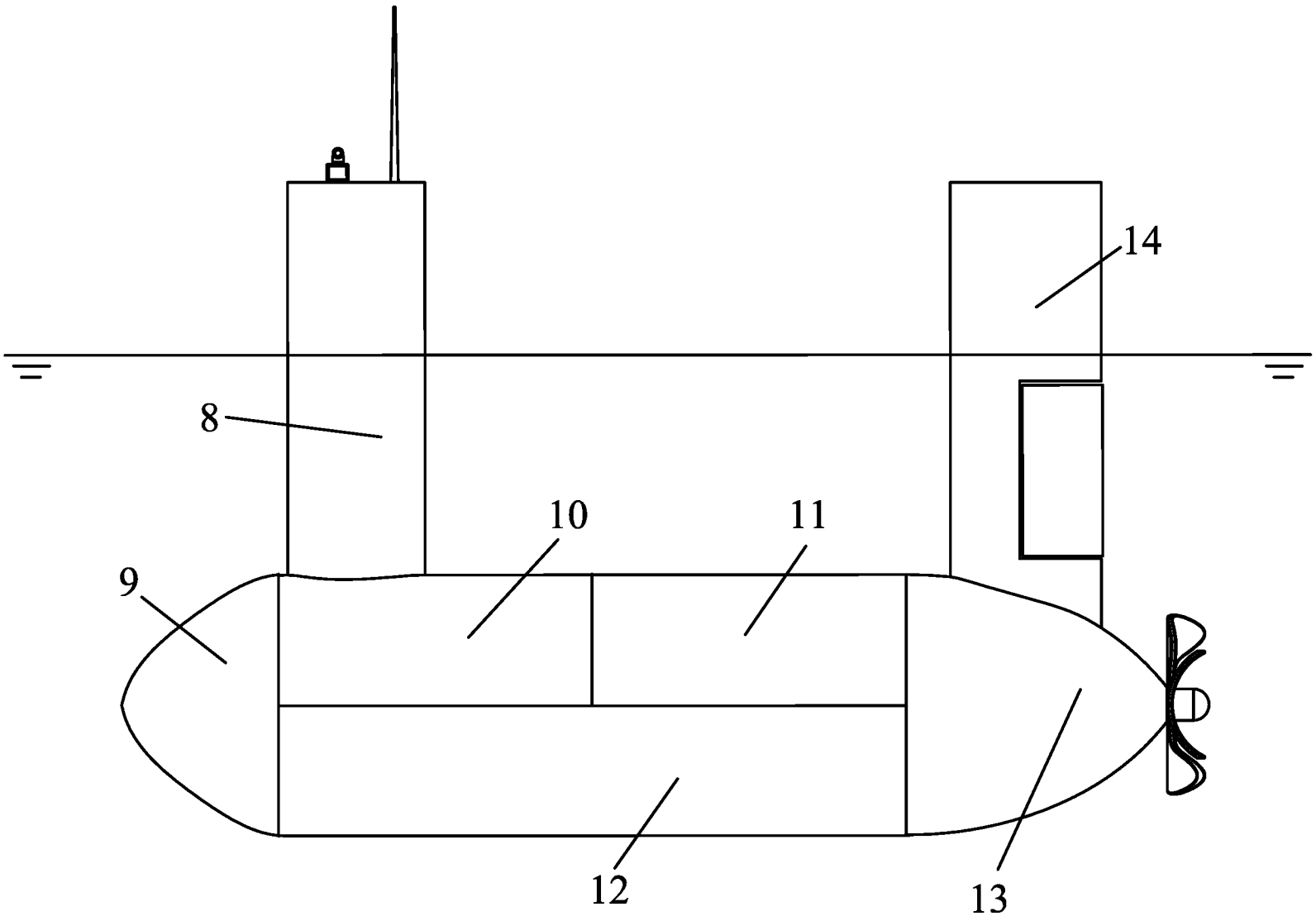
FIG. 2 is a distribution diagram of compartments of an unmanned semi-submarine according to one embodiment of the disclosure.

FIG. 2 illustrates the distribution of compartments of the unmanned semi-submarine. The compartments comprise a front equipment compartment 9, a rear equipment compartment 10, a control equipment compartment 11, a battery compartment 12, and a propelling compartment 13. The compartments are separated from one another using watertight walls 15. The distance between the front buoyancy chamber 8 and the rear buoyancy chamber 14 is directly related to the magnitude of the restoring moment generated by buoyancy difference, so the distance between the front buoyancy chamber 8 and the rear buoyancy chamber 14 is as big as possible. The front equipment compartment 9 and the rear equipment compartment 10 are configured to accommodate the detection equipment such as a sonar and a depth probe. The control equipment compartment is equipped with processors for obstacle avoidance, route planning, and real-time processing detection data. Because the main hull 5 is submerged in the water all along and is unaffected by the storm, so no water is flowed out the main hull, the detection equipment can work stably. The control equipment compartment 11 controls the operation of the unmanned semi-submarine. Specifically, the control equipment compartment controls the unmanned semi-submarine to avoid obstacles via the signals transmitted by the radar 3, real-time transmits the detection data to a base via the antenna 2, and controls the unmanned semi-submarine to sail through the propeller 6 and the rudder 7. The propelling compartment 13 is equipped with a propulsion system and a rudder driving mechanism. The battery pack is installed in the battery compartment 12 for power supply. The battery pack is heavy, and the battery compartment 12 is disposed in the bottom of the main hull, thus increasing the stability of the unmanned semi-submarine.

Figure 3:
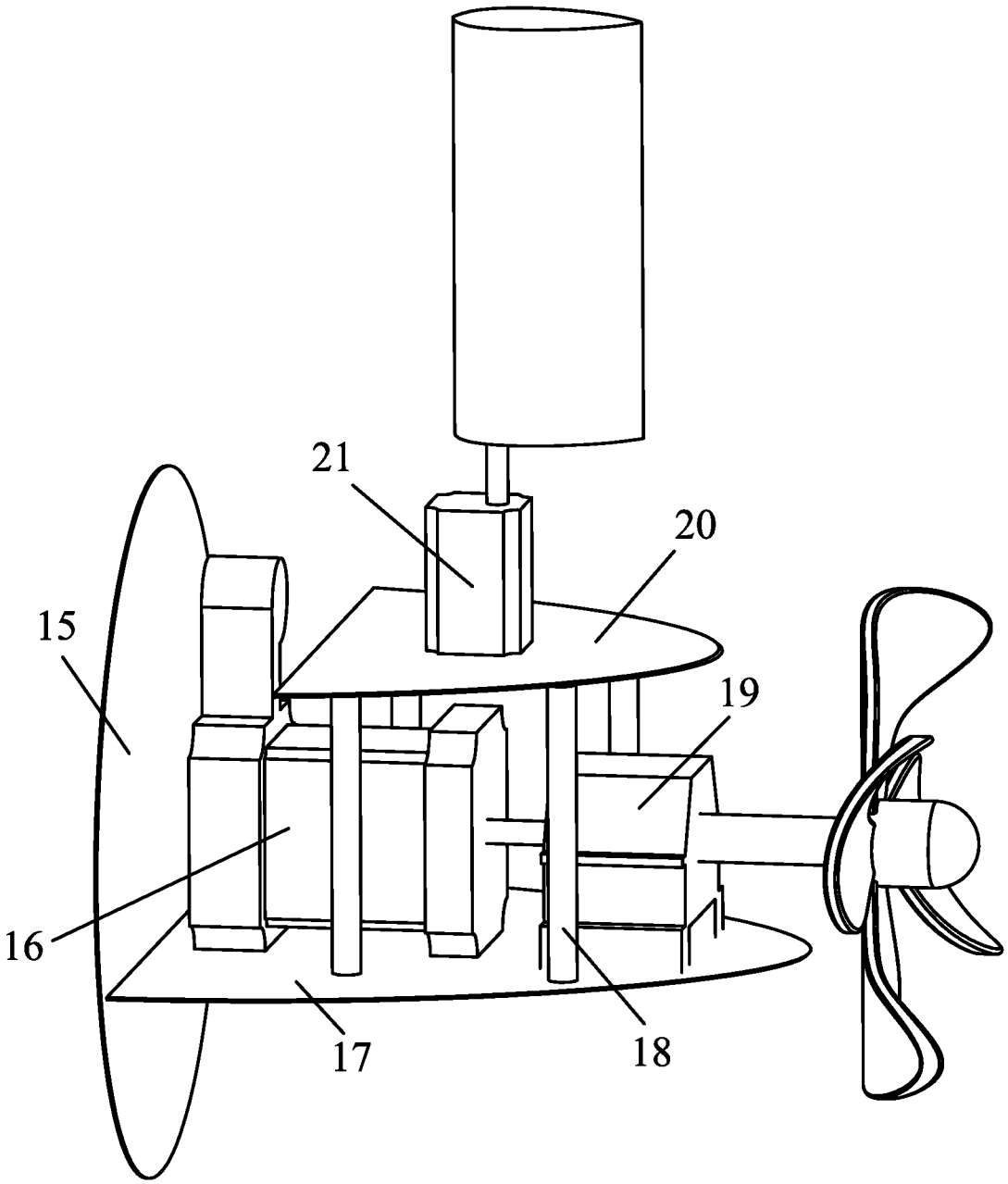
FIG. 3 is a schematic diagram of a propelling compartment of an unmanned semi-submarine according to one embodiment of the disclosure.

FIG. 3 is a schematic diagram of the propelling compartment 13 of the unmanned semi-submarine. ADC motor is disposed in the propelling compartment 13 for propulsion and is connected to a reduction gearbox 19. A transmission shaft decelerated by the reduction gearbox is connected to the propeller 6. The propelling compartment 13 comprises an upper support plate 20 and a lower support plate 17. The DC motor 16 and the reduction gearbox 19 are disposed on the lower support plate 17. The upper support plate 20 is located above the DC motor 16 and the reduction gearbox 19. Support pillars 18 are disposed on the lower support plate 17 and support the upper support plate 20. A driver motor 21 is disposed on the upper support plate 20 to supply steering power for the rudder 7. The DC motor 16 and the drive motor 21 are both controlled by a controller in the control equipment compartment 11. Because the unmanned semi-submarine has a small water plane area, if an internal combustion engine is used, it may cause huge changes in the floating state during the working process due to the fuel consumption, which is not conducive to autonomous navigation and concealment. Employing the DC motor 16 as a driving power can prevent the buoyancy difference of the unmanned semi-submarine resulting from the fuel consumption. In addition, employing the DC motor 16 as a driving power can reduce the arrangement of the intake pipe and exhaust pipe, saving the space of the main hull. Under rough seas, the motor is superior to the internal combustion engine in the operation stability.

Figure 4:
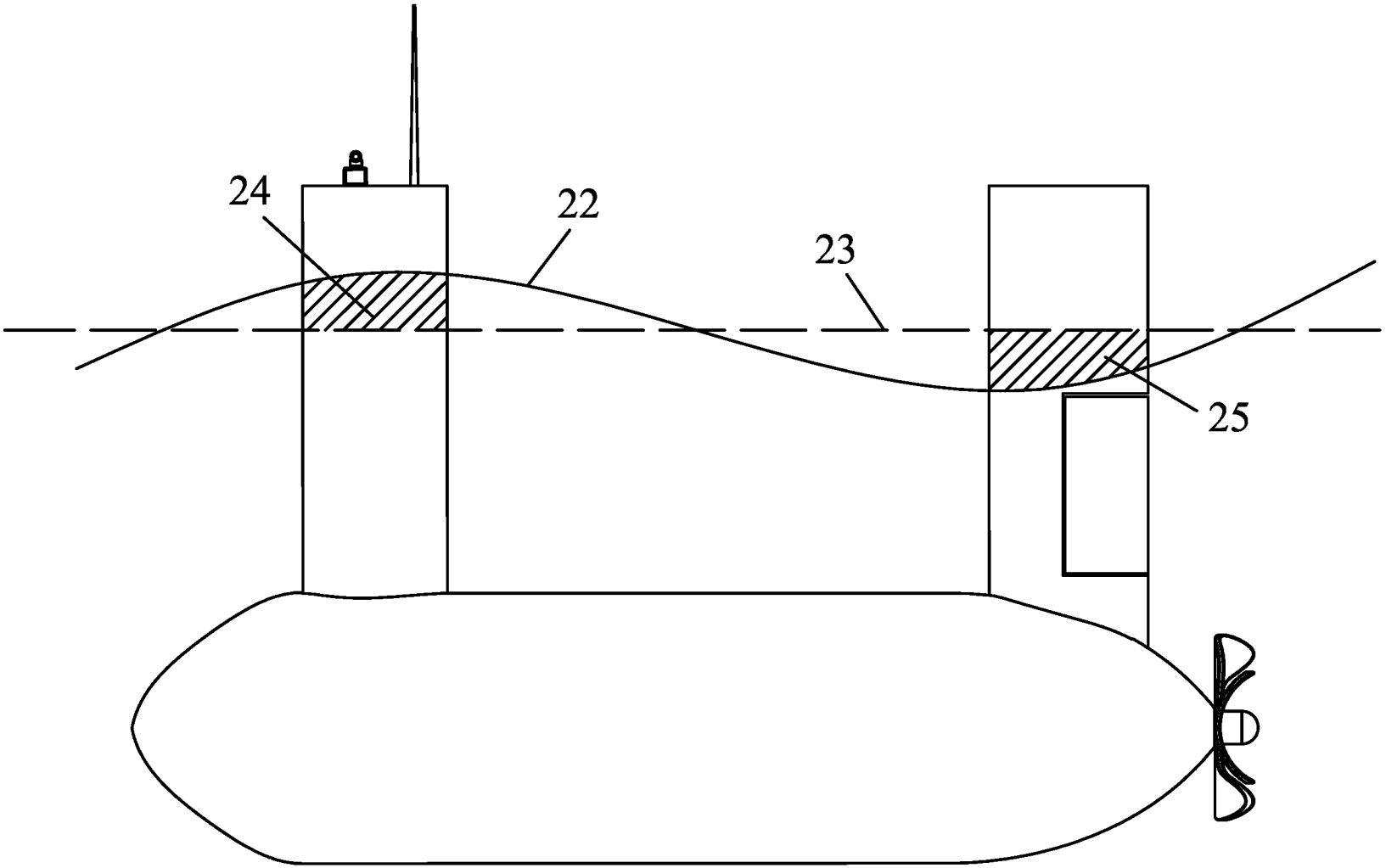
FIG. 4 is a schematic diagram of an unmanned semi-submarine according to one embodiment of the disclosure in a working state.

FIG. 4 is a schematic diagram of the unmanned semi-submarine in a working state. Different from the navigation in the clam sea 23, when the unmanned semi-submarine navigates in the sea wave 22, the front and rear airfoil buoyancy chambers may be in a high water level and a low water level, respectively, and thus a buoyancy increased area 24 is formed in the front buoyancy chamber 8, a buoyancy decreased area 25 is formed in the rear buoyancy chamber 14. Because the water plane area of the two airfoil buoyancy chambers is small, the buoyancy difference of the two airfoil buoyancy chambers is also slight. In this embodiment, the buoyancy chambers are small-sized and suffer little wave pressure. Thus, the unmanned submarines are less affected by external force when working under rough seas, ensuring the stability of the navigation and providing a good working environment for the detection equipment. The airfoil buoyancy chambers can also provide the restoring moment when the unmanned semi-submarine is tilted, controlling the tilt angle in a proper range, increasing the safety of the unmanned semi-submarine.

Meanwhile, because the resistance center of the hull is above the central axis of the main hull 5, the boat tends to trim by the stern in the process of hydrostatic navigation. Increasing the size of the rear buoyancy chamber can reduce the trim by the stern caused by the asymmetry of the resistance center.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An unmanned semi-submarine, comprising:

1) a main hull comprising a longitudinal axis;

2) airfoil buoyancy chambers, the airfoil buoyancy chambers comprising a front buoyancy chamber and a rear buoyancy chamber;

3) an antenna;

4) a radar;

5) a propeller;

6) a rudder; and 7) compartments;

wherein:

the front buoyancy chamber and the rear buoyancy chamber are distributed on the main hull along the longitudinal axis of the main hull;

the radar and the antenna are disposed on a top end of the front buoyancy chamber;

the rudder is disposed on the rear buoyancy chamber to control a forward direction of the unmanned semi-submarine;

the propeller is disposed at a tail of the main hull to drive the unmanned semi-submarine;

a cross-section of the front buoyancy chamber is symmetrical with respect to an axis that is parallel to the longitudinal axis of the main hull;

a cross-section of the rear buoyancy chamber is symmetrical with respect to the axis that is parallel to the longitudinal axis of the main hull;

the compartments comprise a front equipment compartment, a rear equipment compartment, a control equipment compartment, a battery compartment, and a propelling compartment; the compartments are separated from one another by watertight walls;

the radar and the antenna are connected to the control equipment compartment;

the front equipment compartment and the rear equipment compartment are equipped with a sonar and a depth probe;

the control equipment compartment is equipped with processors for obstacle avoidance, route planning, and real-time processing detection data;

the propelling compartment is equipped with a propulsion system and a rudder driving mechanism;

a battery pack is installed in the battery compartment;

the battery compartment is disposed in a bottom of the main hull;

the propelling compartment comprises a DC motor, a reduction gearbox, a transmission shaft, an upper support plate, support pillars, and a lower support plate;

the DC motor is connected to the reduction gearbox; and the reduction gearbox is connected to the propeller via the transmission shaft;

the DC motor and the reduction gearbox are disposed on the lower support plate; and the upper support plate is located above the DC motor and the reduction gearbox;

the support pillars are disposed on the lower support plate; and the upper support plate is supported by the support pillars;

a driver motor is disposed on the upper support plate to supply steering power for the rudder; and the DC motor and the driver motor are both controlled by a controller in the control equipment compartment.

2. The semi-submarine of claim 1, wherein the front buoyancy chamber and the rear buoyancy chamber are spaced apart, and a dimension of the rear buoyancy chamber is larger than a dimension of the front buoyancy chamber.

* * * * *